US007823313B2

(12) United States Patent
Faifer

(10) Patent No.: US 7,823,313 B2
(45) Date of Patent: Nov. 2, 2010

(54) GUNSTOCK

(76) Inventor: Sagi Faifer, POB 280, 43 Yaakov Olamy, Moshav Mishmar Hashiva (IL) 50297

( * ) Notice: Subject to any disclaimer, the term of this patent is extended or adjusted under 35 U.S.C. 154(b) by 0 days.

(21) Appl. No.: 12/819,202

(22) Filed: Jun. 20, 2010

(65) Prior Publication Data

US 2010/0242328 A1 Sep. 30, 2010

Related U.S. Application Data

(63) Continuation-in-part of application No. 12/721,626, filed on Mar. 11, 2010.

(60) Provisional application No. 61/159,498, filed on Mar. 12, 2009.

(51) Int. Cl.
*F41C 23/00* (2006.01)

(52) U.S. Cl. ..... 42/74; 42/1.06; 42/71.01; 42/73; 42/75.03

(58) Field of Classification Search ..... 42/1.06, 42/71.01, 72, 73, 74, 75.03
See application file for complete search history.

(56) References Cited

U.S. PATENT DOCUMENTS

| | | | |
|---|---|---|---|
| 1,783,246 | A | 12/1930 | Ledford |
| 5,941,005 | A | 8/1999 | Battaglia et al. |
| 5,974,718 | A | 11/1999 | Bentley et al. |
| 6,637,141 | B1 | 10/2003 | Weatherby et al. |
| 6,732,466 | B2 | 5/2004 | Bentley |
| 6,848,351 | B1 | 2/2005 | Davies |
| 2003/0182837 | A1 | 10/2003 | Burigana |
| 2008/0110074 | A1 | 5/2008 | Bucholtz et al. |

FOREIGN PATENT DOCUMENTS

| | | |
|---|---|---|
| ES | 2166655 | 10/2003 |
| FR | 516596 | 4/1921 |
| FR | 2686686 | 7/1993 |
| GB | 404494 | 1/1934 |
| KR | 20070059673 | 11/2007 |
| NL | 290784 | 3/1963 |
| WO | 2008030128 | 6/2008 |

*Primary Examiner*—Michael Carone
*Assistant Examiner*—Daniel J Troy
(74) *Attorney, Agent, or Firm*—Deborah A. Gador

(57) ABSTRACT

A collapsible stock which includes a stock body having a buffer tube holder, a firearm buffer tube slidingly mounted in the buffer tube holder, the stock body being arranged for linear reciprocating motion relative to the buffer tube during firing of the firearm, a recoil absorbing mechanism mounted inside the stock body and affixed to the buffer tube, and a locking pin mounted through the stock body and affixed to the buffer tube, the stock body being arranged for motion relative to the locking pin during firing of the firearm.

11 Claims, 3 Drawing Sheets

GUNSTOCK

RELATED APPLICATIONS

This application is a Continuation In Part of U.S. Ser. No. 12/721,626 filed 11 Mar. 2010 and claims the benefit of U.S. Provisional Application No. 61/159,498 filed 12 Mar. 2009, the entire disclosures of which are incorporated herein by reference.

FIELD OF THE INVENTION

The present invention relates to a gunstock for firearms, in general and, in particular, to a stock for M16-type firearms.

BACKGROUND OF THE INVENTION

One of the age old problems with firearms is the fact many of them have a strong recoil that affects the person firing the weapon. Recoil in firearms causes problems such as flinching, jerking the gun, raising the head, stopping the swing and others. In firearms such as shotguns and rifles, the rear end of the butt stock is held against the shooter's shoulder and the recoil often causes the shooter to raise the front of the firearm each time the weapon is fired.

The amount of recoil varies depending upon the amount of explosive in the shell being fired. When using smaller caliber ammunition, M16 firearms do not need a strong recoil reduction mechanism. They typically include a recoil spring that serves both as the operating spring and as a recoil buffer. However, as the caliber of ammunition used in these firearms increases, the recoil substantially increases and can result in pain and or bruising to the shoulder area of the person firing the weapon. Recoil is partially handled, in many cases, by the addition of a recoil pad, recoil reducer, barrel porting or a compression butt plate to the firearm. However, when larger caliber ammunition is used, these partial solutions become unsatisfactory.

Alternate solutions include cutting the stock into two portions, typically by removing the butt plate, and the two portions are enabled to move relative to one another to absorb the recoil. There is shown, for example, in U.S. Pat. No. 6,637,141 to Weatherby et al., a gunstock formed with a stationary portion and a rotating portion having a flexible hinge mechanism that substantially reduces both the recoil and the tendency of the gun to move upward or jerk when it is fired. A receiver extension (buffer tube) extends through both portions. The mechanism includes a sliding pin whose head is affixed in the stationary portion and whose end extends into an arcuate channel in the rotating portion.

Thus, there is a long felt need for improved recoil mitigation for firearms of the M-16 type that retains the shape and function of the firearm.

There are also known M16 firearms with collapsible stocks. These firearms were designed to be both handier and lighter in weight than the same firearm would be with a standard stock. Collapsible stocks are a feature of a gun whereby the stock can be lengthened or shortened to fit the user, or to allow the gun to be stored more easily. The stock includes a reciprocating pin that seats in one of a plurality of grooves defined in the bottom of the buffer tube so as to lock the buffer in place during firing. By retracting the pin, the buffer tube can be moved telescopingly into and out of the buffer tube holder in the stock to adjust the length of the stock. The pin then locks the buffer tube in place before the firearm is fired.

SUMMARY OF THE INVENTION

The present invention relates to a collapsible firearm stock, particularly an M16-type stock, having a built-in mechanism for recoil mitigation. The stock includes a first portion abutting a user's shoulder and a second portion coupled to the firearm buffer tube. The two portions are reciprocatingly movable relative to one another. A recoil absorbing mechanism is disposed inside the stock, between the two portions, so as to mitigate the recoil caused by the firearm.

There is thus provided, according to the present invention, a collapsible firearm stock including a stock body having a buffer tube holder, a firearm buffer tube slidingly mounted in the buffer tube holder, the stock body being arranged for linear reciprocating motion relative to the buffer tube during firing of the firearm, a recoil absorbing mechanism mounted inside the stock body and affixed to the buffer tube, and a locking pin mounted through the stock body and affixed to the buffer tube, the stock body being arranged for motion relative to the locking pin during firing of the firearm.

According to one embodiment of the invention, the recoil absorbing mechanism includes a recoil block reciprocatingly mounted in a track in the stock body and a locking pin for coupling the recoil block to the firearm buffer tube.

Further according to one embodiment, the firearm stock further includes a stop member disposed in the track for closing the track and preventing the recoil block from falling out of the stock body, and a recoil absorbing element coupled to the recoil block.

There is also provided, according to the present invention, a method for forming a firearm stock, the method including forming a stock body having a buffer tube holder, mounting a firearm buffer tube in the buffer tube holder for reciprocating motion relative to one another, mounting a recoil absorbing mechanism in the stock body, and affixing the recoil absorbing mechanism to the buffer tube.

According to some embodiments, the step of mounting a recoil absorbing mechanism includes disposing a recoil block for reciprocating movement in a track in the stock body, and coupling the recoil block to the firearm buffer tube by means of a locking pin.

BRIEF DESCRIPTION OF THE DRAWINGS

The present invention will be further understood and appreciated from the following detailed description taken in conjunction with the drawings in which.

DETAILED DESCRIPTION OF THE INVENTION

The present invention relates to a collapsible firearm stock having a built-in mechanism for recoil mitigation. The stock includes a first portion, a stock body with buffer tube holder, designed to abut a user's shoulder, and a second portion, coupled to the firearm buffer tube. These two portions are reciprocatingly movable relative to one another. A recoil absorbing mechanism is disposed inside the stock between the two portions and affixed to the buffer tube, and a locking pin is mounted through the stock body and affixed to the buffer tube. The stock body is arranged for motion relative to the locking pin during firing of the firearm, so as to mitigate the recoil caused by firing the firearm.

Figure 1:
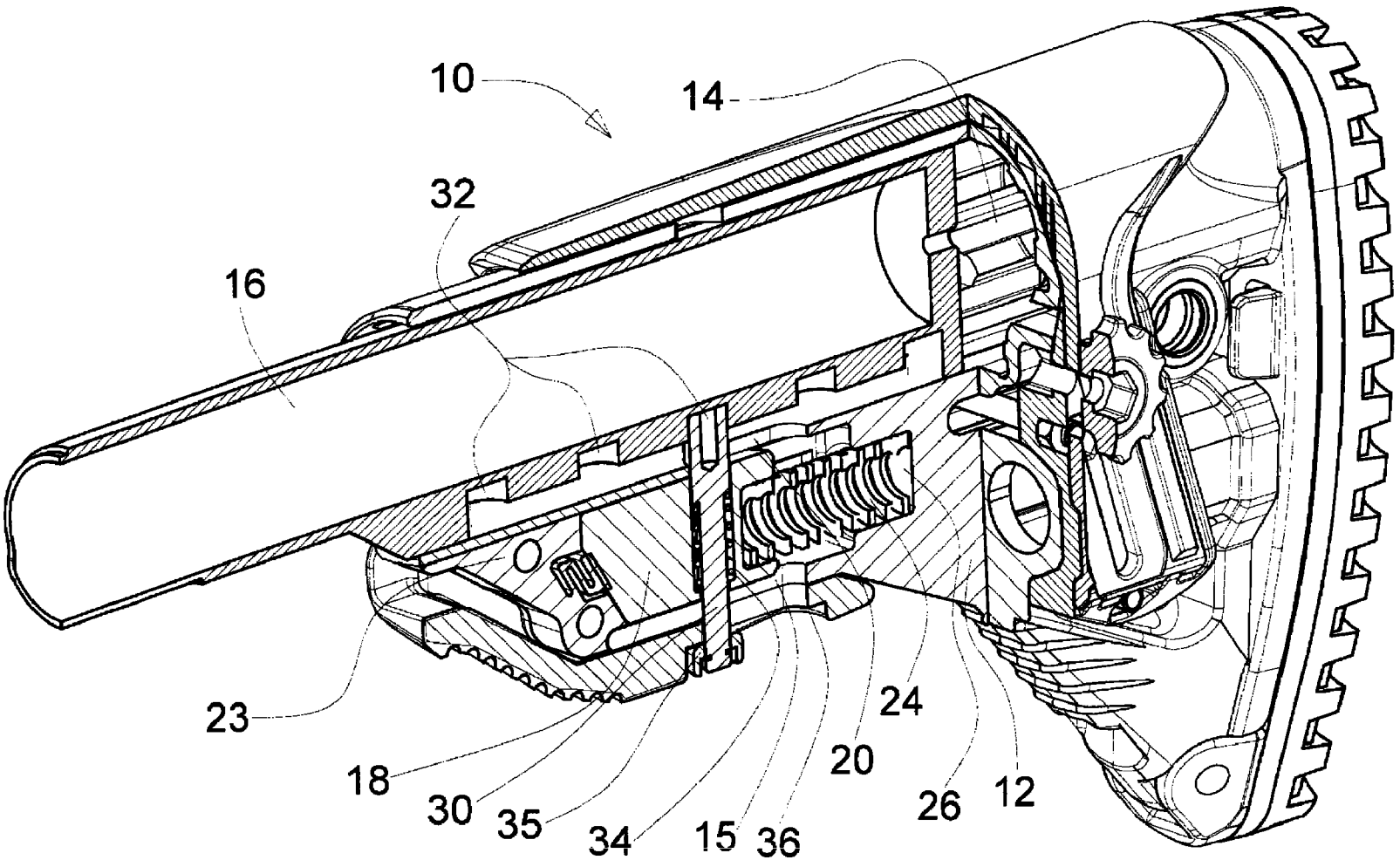
FIG. 1 is a schematic, partially cut-away, perspective view of a stock with a recoil mitigation mechanism constructed and operative in accordance with one embodiment of the present invention, in a non firing orientation.
Figure 2:
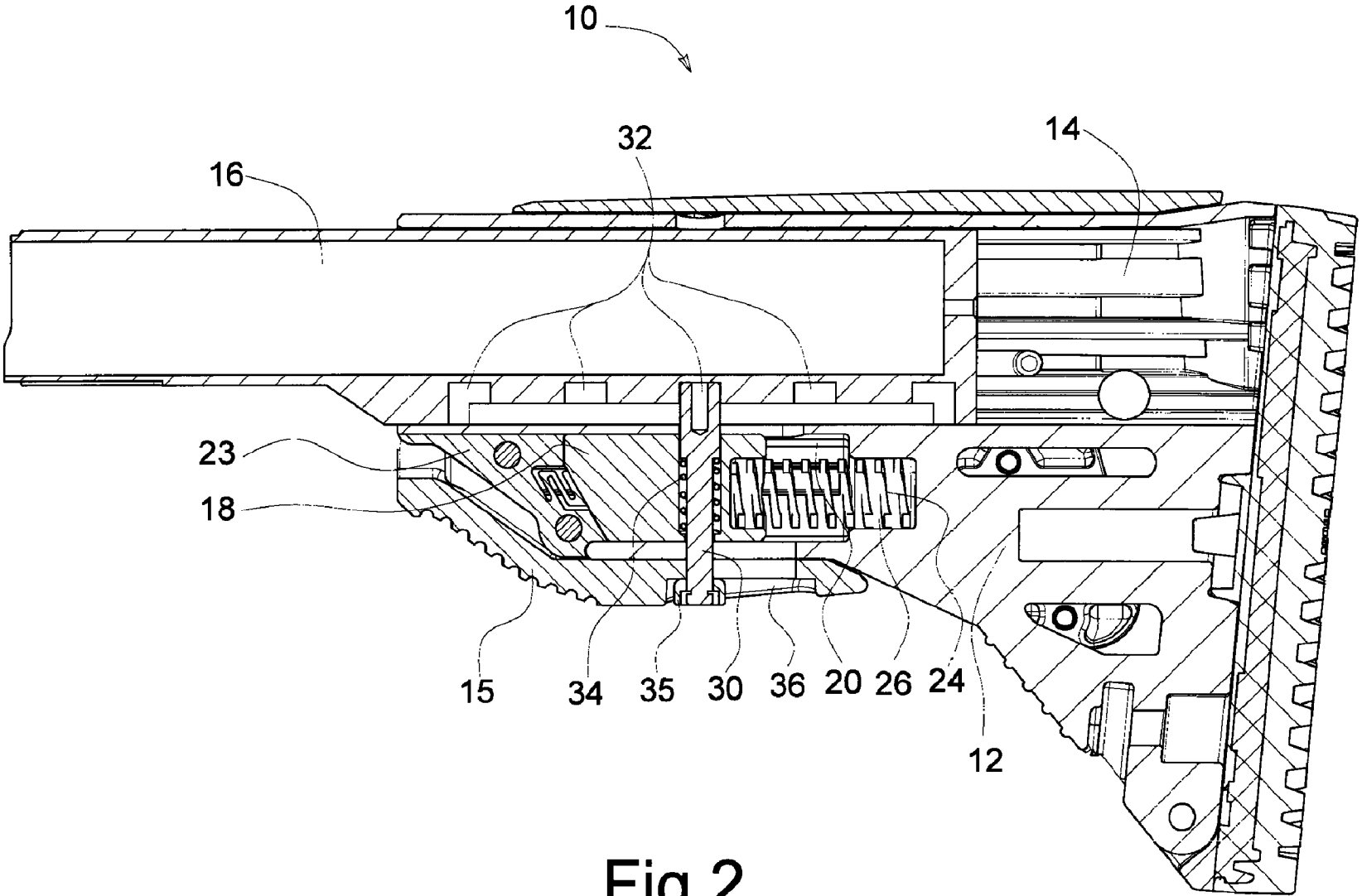
FIG. 2 is a schematic side sectional view of the stock of FIG. 1.

FIGS. 1 and 2 are a partial cut-away perspective view and a side sectional view, respectively, of a collapsible stock 10 having a recoil mitigation mechanism constructed and operative according to one embodiment of the invention. Stock 10 includes a first portion, including a conventional stock body 12 defining a buffer tube holder 14, and a second portion, including a buffer tube 16, configured for reciprocating motion relative to one another. Buffer tube 16 is reciprocatably mounted in buffer tube holder 14, as known. Buffer tube 16 includes a plurality of slots 32 allowing the user to adjust the length of the firearm. A spring-loaded reciprocating locking pin 30 couples stock body 12 to buffer tube 16 by engaging one of the slots 32 provided in buffer tube 16, substantially as known. A locking spring 34 urges the top portion of locking pin 30 into one of slots 32.

A recoil mitigation mechanism 15 is mounted inside stock body 12 and coupled to buffer tube 16. Recoil mitigation mechanism 15 is mounted in a hollow space in the stock body defined under buffer tube holder 14. According to preferred embodiments of the invention, recoil mitigation mechanism 15 includes a recoil block 18 that is reciprocatingly mounted in a track 20 defined in the stock body 12. A stop member 23 is provided in the hollow space under buffer tube holder 14 for closing track 20 and preventing recoil block 18 from falling out of the stock body 12. Recoil block 18 is coupled to a recoil absorbing element, here illustrated as a damping spring 24, mounted in a spring mounting cavity 26. Alternatively, the recoil absorbing element can be any other kinetic energy absorbing element.

Unlike conventional collapsible stock bodies, stock body 12 includes a stop groove 36 defined along a portion of recoil block 18 and extending transversely to the longitudinal axis of the recoil block 18. Locking pin 30 is slideably mounted in stop groove 36 for reciprocating movement from one end of the groove to the other. Locking pin 30 includes a depending flange 35 seated in the lower portion of stop groove 36. Flange 35 acts as a stop member for locking pin 30 by engaging the side walls of stop groove 36.

Locking pin 30 passes through recoil block 18 into slot 32 of buffer tube 16, thereby causing concomitant motion of recoil block 18 with buffer tube 16. In this case, during recoil, there is relative movement between stock body 12 and the buffer tube 16, which moves together with recoil mitigation mechanism 15 and locking pin 30. It will be appreciated that the length of stop groove 36 limits the distance locking pin 30 and recoil block 18 can move in the stock body.

Figure 3:
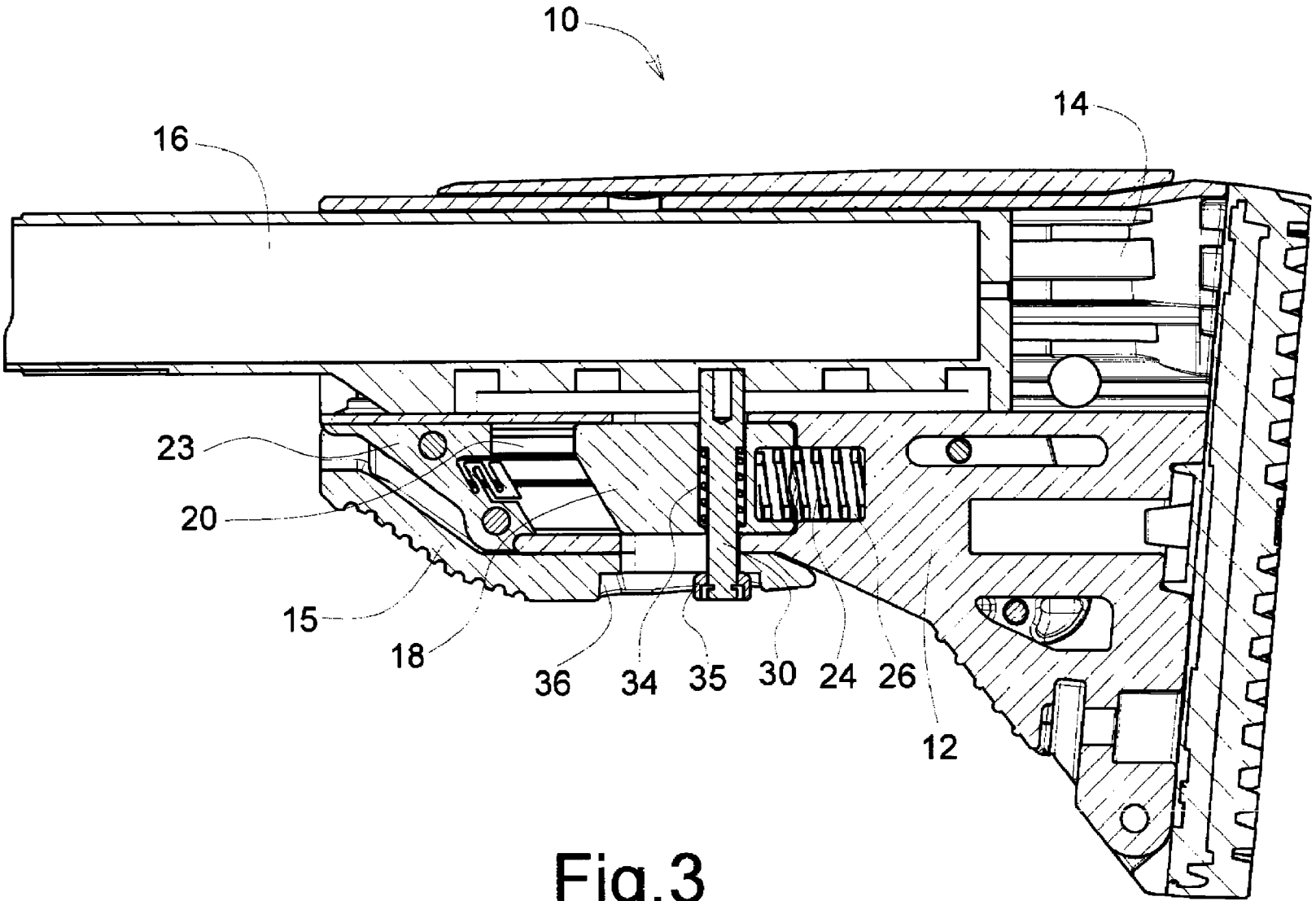
FIG. 3 is a schematic side sectional view of the stock of FIG. 1 in a recoil absorbing orientation.

In operation, when the firearm is fired, buffer tube 16 move backwards as a result of the recoil energy. As can be seen in FIG. 3, when buffer tube 16 slides along buffer tube holder 14, locking pin 30 and recoil block 18 slide with it. This motion of buffer tube 16 and recoil block 18 compresses damping spring 24, which absorbs at least part of the recoil energy. Once the recoil energy is completely absorbed, damping spring 24 urges recoil block 18 and buffer tube 16 forwards to their resting position, shown in FIG. 1. The reciprocating motion of recoil block 18 is restricted by stop member 23 and by the abutment of flange 35 against the end of stop groove 36.

It will be appreciated that a number of alternative embodiments of the invention are envisaged, wherein the buffer tube moves relative to the stock body are arranged for reciprocating motion relative to one another with a mitigation mechanism disposed between them.

While the invention has been described with respect to a limited number of embodiments, it will be appreciated that many variations, modifications and other applications of the invention may be made. It will further be appreciated that the invention is not limited to what has been described hereinabove merely by way of example. Rather, the invention is limited solely by the claims which follow.

The invention claimed is:

1. A collapsible firearm stock comprising:

a stock body including a buffer tube holder;

a firearm buffer tube slidingly mounted in said buffer tube holder;

said stock body being arranged for linear reciprocating motion relative to said buffer tube during firing of the firearm;

a recoil absorbing mechanism mounted inside said stock body and affixed to said buffer tube; and a locking pin mounted through said stock body and affixed to said buffer tube, said stock body being arranged for motion relative to said locking pin during firing of the firearm.

2. The firearm stock according to claim 1, wherein said recoil absorbing mechanism includes:

a recoil block reciprocatingly mounted in a track in said stock body;

wherein said locking pin couples said recoil block to said firearm buffer tube, and wherein said stock body is arranged for reciprocating motion relative to said recoil mechanism during firing of the firearm.

3. The firearm stock according to claim 2, further comprising:

a stop member disposed in said track for closing said track and preventing said recoil block from falling out of the stock body; and a recoil absorbing element coupled to said recoil block.

4. The firearm stock according to claim 3, wherein said recoil block is spring loaded in said track and said recoil absorbing element includes a damping spring mounted in a spring mounting cavity in said stock body.

5. The firearm stock according to claim 1, wherein:

said stock body further comprises a stop groove; and said locking pin is slideably mounted in said stop groove for reciprocating movement from one end of said groove to another.

6. The firearm stock according to claim 5, wherein said locking pin further comprises a depending flange disposed in said stop groove and disposed to act as a stop member to limit movement of said locking pin in said groove.

7. A method for forming a firearm stock, the method comprising:

forming a stock body having a buffer tube holder;

slidingly mounting a firearm buffer tube in said buffer tube holder for linear reciprocating motion of said stock body relative to said buffer tube during firing of the firearm;

mounting a recoil absorbing mechanism inside said stock body and affixing said recoil absorbing mechanism to said buffer tube; and mounting a locking pin through said stock body and affixing said locking pin to said buffer tube, said stock body being arranged for motion relative to said locking pin during firing of the firearm.

8. The method according to claim 7, wherein said step of mounting a recoil absorbing mechanism includes:

disposing a recoil block for reciprocating motion in a track in said stock body; and coupling said recoil block to said firearm buffer tube by means of said locking pin.

9. The method according to claim 8, further comprising:

disposing a stop member in said track for closing said track and preventing said recoil block from falling out of the stock body; and coupling a recoil absorbing element to said recoil block.

10. The method according to claim 9, wherein said step of coupling a recoil absorbing element includes:

mounting a damping spring in a spring mounting cavity in said stock body; and coupling said damping spring to said recoil block.

11. The method according to claim 8, further comprising;

forming a stop groove in said stock body; and slideably mounting said locking pin is in said stop groove for reciprocating movement from one end of said groove to another.

* * * * *